US007607658B2

(12) United States Patent
Fujiwara

(10) Patent No.: US 7,607,658 B2
(45) Date of Patent: Oct. 27, 2009

(54) SHEET CONVEYANCE APPARATUS HAVING MECHANISM FOR FLEXIBLY CONTROLLING INTERVAL BETWEEN SHEETS AND IMAGE FORMING APPARATUS

(75) Inventor: Hiroshi Fujiwara, Osaka-fu (JP)

(73) Assignee: Ricoh Co., Ltd., Tokyo (JP)

( * ) Notice: Subject to any disclaimer, the term of this patent is extended or adjusted under 35 U.S.C. 154(b) by 168 days.

(21) Appl. No.: 11/472,378

(22) Filed: Jun. 22, 2006

(65) Prior Publication Data

US 2006/0290049 A1 Dec. 28, 2006

(30) Foreign Application Priority Data

Jun. 22, 2005 (JP) ..... 2005-182656
Jul. 21, 2005 (JP) ..... 2005-211188
Jan. 17, 2006 (JP) ..... 2006-008667

(51) Int. Cl.
*B65H 29/00* (2006.01)
*G03G 15/00* (2006.01)

(52) U.S. Cl. ..... 271/186; 271/301; 271/291; 399/364; 399/374; 399/401

(58) Field of Classification Search ..... 271/186, 271/301, 291, 65, 185, 258.01, 225; 399/364, 399/374, 401
See application file for complete search history.

(56) References Cited

U.S. PATENT DOCUMENTS 4,956,678 A * 9/1990 Kiya et al. ..... 399/401
5,448,348 A * 9/1995 Azeta ..... 399/364
5,461,468 A * 10/1995 Dempsey et al. ..... 399/396
5,534,989 A * 7/1996 Rubscha et al. ..... 399/381
5,713,060 A * 1/1998 Sato et al. ..... 399/20
6,393,252 B1 * 5/2002 Yamagishi ..... 399/401
6,411,795 B2 * 6/2002 Okamoto ..... 399/401
6,530,569 B2 * 3/2003 Yamagishi ..... 271/270
6,577,844 B2 * 6/2003 Kamei ..... 399/401
6,736,390 B2 * 5/2004 Chihara ..... 271/186
2006/0290049 A1 12/2006 Fujiwara

FOREIGN PATENT DOCUMENTS

JP 2825846 9/1998
JP 2002-154751 5/2002
JP 2002-365862 12/2002
JP 2004-269090 9/2004
JP 2005-067051 3/2005

OTHER PUBLICATIONS

U.S. Appl. No. 11/758,311, filed Jun. 5, 2007, Ohta, et al.

* cited by examiner

*Primary Examiner*—Patrick H Mackey
*Assistant Examiner*—Luis Gonzalez
(74) *Attorney, Agent, or Firm*—Oblon, Spivak, McClelland, Maier & Neustadt, L.L.P.

(57) ABSTRACT

A sheet conveyance apparatus includes a sheet conveyance path, a first conveyance mechanism located upstream in the sheet conveyance path, and a first drive mechanism configured to drive the first conveyance mechanism. The apparatus further includes a second conveyance mechanism located downstream in the sheet conveyance path, a second drive mechanism configured to drive the second conveyance mechanism, a first intermediate conveyance mechanism located between the first and second conveyance mechanisms in the sheet conveyance path, and a first drive transmission mechanism configured to intermittently transmit drive force from the first drive mechanism to the first intermediate conveyance mechanism. The sheet conveyance apparatus can be provided in an image forming apparatus.

16 Claims, 5 Drawing Sheets

SHEET CONVEYANCE APPARATUS HAVING MECHANISM FOR FLEXIBLY CONTROLLING INTERVAL BETWEEN SHEETS AND IMAGE FORMING APPARATUS

BACKGROUND OF THE INVENTION

1. Field of the Invention

The present invention relates to a sheet conveyance apparatus for use in an image forming apparatus, and more particularly to a sheet conveyance apparatus having a mechanism for flexibly controlling an interval between sheets for use in a sheet reversing unit of an image forming apparatus.

2. Discussion of the Background

Against a background in which an amount of data used in business operation is increasing, there has been a growing demand to reduce an amount of paper used for printing such increased data. As a solution, double-sided image forming is performed so that the amount of paper used for printing can be reduced to cut cost. For an image forming apparatus to have a double-sided image forming function, a mechanism for reversing a sheet is required for transferring image information to two sides of the sheet by using a single transfer unit or a series of transfer units. Many sheet reversing units adopt a switchback mechanism for reversing a sheet having an image formed on one side thereof while the sheet is conveyed. For such a sheet reversing unit to successively reverse a plurality of sheets, a conveyance path and an interval between sheets need to be long enough for performing a switchback operation.

On the other hand, there has also been growing demand for increases in speed and productivity of image forming. Therefore, is it difficult for an image forming apparatus to have a conveyance path having a length long enough for reversing a sheet, while at the same time having enough of an interval between sheets in order to archive an increase in image forming speed. Additionally, the trend in the image forming apparatus industry is towards reducing the size of the image forming apparatus.

Further, efforts for improving the productivity of image forming, which is represented by a number of sheets on which image forming is performed in a unit time, have been made by not only increasing the speed of conveying a sheet but also reducing the interval between sheets. Therefore, a sheet needs to be reversed in an increasingly shorter period of time.

In recent years, along with information digitalization, interleaf control for double-sided image forming has been developed. In an interleaf control operation, a first image forming is successively performed on first sides of a plurality of sheets while the sheets are conveyed into a reverse path after the images are formed. Then, image forming is alternately performed on second sides of the sheets having the images formed on the first sides and newly supplied sheets.

A background sheet conveyance apparatus includes two driving sources independently provided for conveying a sheet into a reverse system and for supplying a sheet having an image formed on one side thereof so that productivity can be improved with a low-cost configuration.

Another background sheet conveyance apparatus includes two motors configured to independently operate. One of the two motors serves as a driving source for conveying a sheet for a discharge operation. The other serves as another driving source for conveying a sheet for a double-sided image forming operation.

Further recently, non-stack interleaf control for double-sided image forming has been in use. In a non-stack interleaf control operation, a sheet having an image formed on one side thereof is supplied for image forming on another side thereof without putting the sheet in an intermediate stack tray. For improved productivity, performing the non-stack interleaf control needs a mechanism for suspending conveyance of a sheet in a conveyance path located between a sheet reversing unit and a position of a pair of registration rollers arranged upstream of an image forming unit in a sheet conveyance direction. Without the mechanism, a long interval is needed between sheets, resulting in lowered productivity of image forming. A large-scale and high-speed image forming apparatus for performing double-sided image forming by using the non-stack interleaf control, in general, has a long conveyance path, thereby resulting in, in particular, lowered productivity.

For such an image forming apparatus to have a shorter interval between sheets, a plurality of waiting positions need to be arranged for a sheet. When an image to be formed includes a great amount of data (e.g. a picture), a sheet waits at a registration position before image forming for a long time. As a result, following sheets may come into conflict with each other.

Another background sheet conveyance apparatus includes a mechanism for causing a plurality of sheets to wait in a conveyance path. Further, a distance between a reverse unit and a registration unit is configured to be greater than 216 mm multiplied by a number of sheets subjected to an interleaf operation. The mechanism includes a plurality of drive units independently driven by respective motors so that the plurality of sheets can be stopped at respective waiting positions.

SUMMARY OF THE INVENTION

This patent specification describes a sheet conveyance apparatus including a sheet conveyance path, a first conveyance mechanism located upstream in the sheet conveyance path, a first drive mechanism configured to drive the first conveyance mechanism, a second conveyance mechanism located downstream in the sheet conveyance path, a second drive mechanism configured to drive the second conveyance mechanism, a first intermediate conveyance mechanism located between the first and second conveyance mechanisms in the sheet conveyance path, and a first drive transmission mechanism configured to intermittently transmit drive force from the first drive mechanism to the first intermediate conveyance mechanism. This patent specification further describes an image forming apparatus including the sheet conveyance apparatus.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
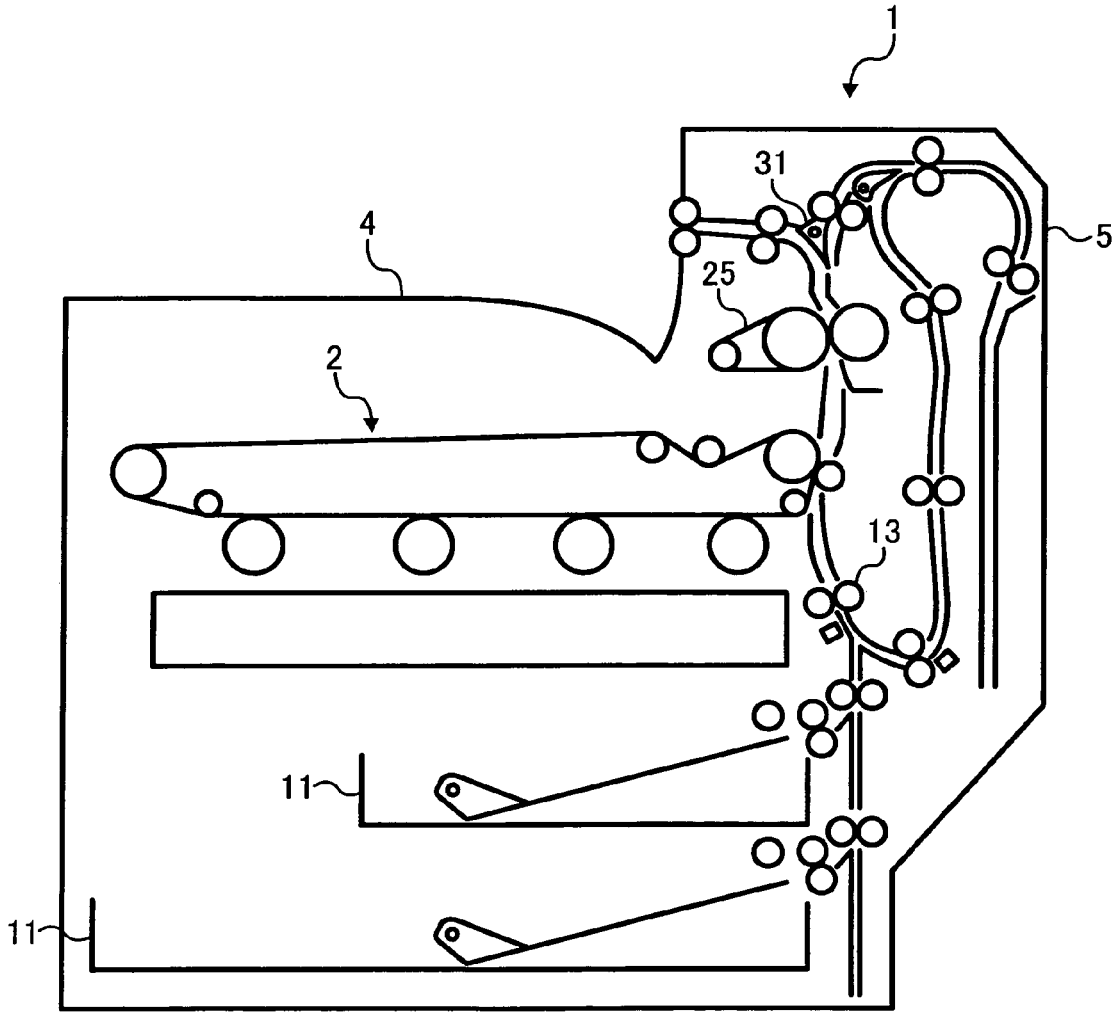
FIG. 1 is a schematic illustration of a general configuration of an image forming apparatus including a sheet reversing unit according to an embodiment of the present invention.

In describing preferred embodiments illustrated in the drawings, specific terminology is employed for the sake of clarity. However, the disclosure of this patent specification is not intended to be limited to the specific terminology so selected and it is to be understood that each specific element includes all technical equivalents that operate in a similar manner. Referring now to the drawings, wherein like reference numerals designate identical or corresponding parts throughout the several views, particularly to FIG. 1, an image forming apparatus according to a preferred embodiment of the present invention is described.

A general configuration of an image forming apparatus 1 using an electrophotographic method such as a laser printer is described below referring to FIG. 1. As shown in FIG. 1, the image forming apparatus 1 includes an image forming unit 2, a sheet discharge tray 4, a sheet reversing unit 5, a plurality of sheet feeding trays 11, a pair of registration rollers 13, a fixing unit 25, and a sheet branch pawl 31.

The image forming unit 2 includes a plurality of photoconductors serving as latent image bearing members, charging mechanisms (not shown), a latent image forming mechanism (not shown), developing devices (not shown), and an intermediate transfer belt.

The plurality of sheet feeding trays 11 adopting a front loading method are located below the image forming unit 2. The sheet discharge tray 4 is located above the image forming unit 2.

The sheet reversing unit 5 is vertically arranged at a right side of a sheet conveyance path which is vertically arranged for transferring an image onto a sheet. The sheet branch pawl 31 is located downstream of the sheet conveyance path.

An image forming mechanism of the image forming apparatus 1 is basically the same as a background image forming mechanism. In the image forming unit 2, the plurality of photoconductors are driven to rotate in a clockwise direction, as shown in FIG. 1. Surfaces of the photoconductors are evenly charged by the charging mechanisms, and are exposed to light by the latent image forming mechanism according to image information so that electrostatic latent images are formed on the surfaces of the photoconductors. Then, the electrostatic latent images are developed by the developing devices so that toner images are formed on the respective photoconductors. The toner images are then transferred onto the intermediate transfer belt to form a full color toner image.

In the meantime, the sheet feeding tray 11 puts out a sheet serving as a recording medium to the right in FIG. 1. Then, the sheet is substantially vertically conveyed in an upward direction. The sheet is further conveyed to the image forming unit 2 by the pair of registration rollers 13 in a predetermined timing.

The full color toner image is then transferred onto the sheet, and fixed by the fixing unit 25 so that the sheet has an image on one side thereof. The sheet having the image is finally discharged to the sheet discharge tray 4.

In a case of double-sided image forming, a sheet having an image formed on one side thereof is conveyed into a sheet reversing unit 5 by using the sheet branch pawl 31. The sheet reversing unit 5 switchbacks the sheet, and feeds the sheet again to the pair of registration rollers 13. The sheet is then conveyed to the image forming unit 2 where another image is transferred and fixed onto the other side of the sheet. The sheet having images formed on both sides thereof is discharged to the sheet discharge tray 4.

In the image forming apparatus 1 according to the embodiment of the present invention, the sheet is discharged face-down, and, therefore, a plurality of sheets are discharged in an ascending order of page numbers. In the case of double-sided image forming, a second page is printed first, and a first page is printed thereafter.

A general configuration of the sheet reversing unit 5 is described below referring to FIGS. 2 to 4.

Figure 2:
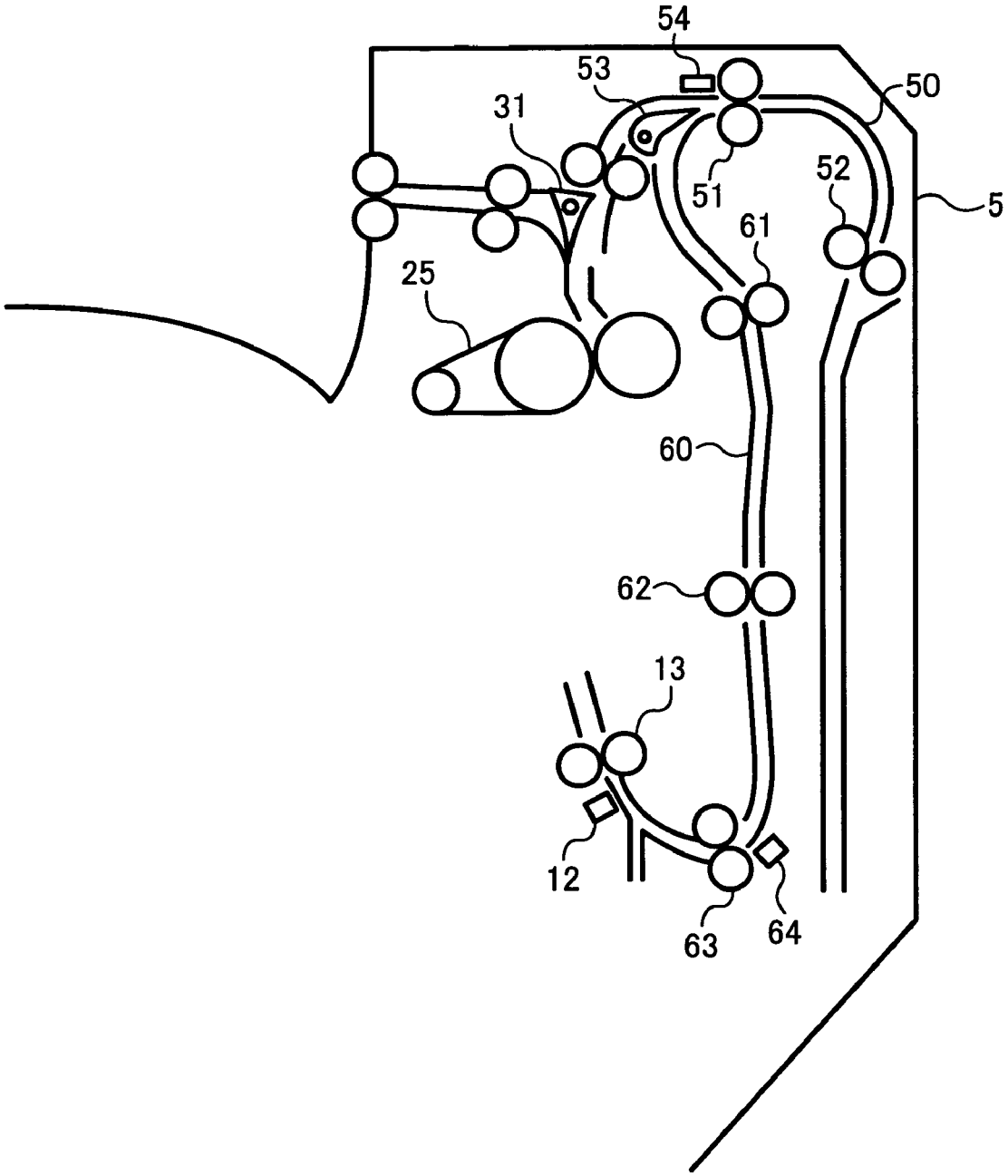
FIG. 2 is a schematic illustration for explaining sheet conveyance rollers and paths of the sheet reversing unit shown in FIG. 1.

As shown in FIG. 2, components of the sheet reversing unit 5 include a registration sensor 12, a carry-in conveyance path 50, a reverse branch pawl 53, an entry sensor 54, a carry-out conveyance path 60, and an exit sensor 64.

The sheet reversing unit 5 includes two conveyance paths, the carry-in conveyance path 50 and the carry-out conveyance path 60. The carry-in conveyance path 50 includes a reverse roller 51 and a reverse conveyance roller 52. The carry-out conveyance path 60 includes a first intermediate conveyance roller 61, a second intermediate conveyance roller 62, and a carry-out roller 63. The carry-out conveyance path 60 is substantially vertically arranged.

The carry-in conveyance path 50 receives a sheet when the sheet branch pawl 31 causes the sheet to be conveyed into the sheet reversing unit 5. The carry-out conveyance path 60 conveys the sheet in a downward direction when the sheet is brought therein by the reverse branch pawl 53 after a conveyance direction of the sheet is reversed. The sheet conveyed in the carry-out conveyance path 60 is brought into the sheet conveyance path which conveys a sheet supplied from the sheet feeding tray 11.

The reverse branch pawl 53 includes a pawl and a solenoid (not shown), and is located upstream of the reverse roller 51. The reverse branch pawl 53 leads a sheet to the reverse roller 51 when the pawl is in a default position. Further, the reverse branch pawl 53 leads a sheet brought out by the reverse roller 51 after a switchback operation to the carry-out conveyance path 60 when the pawl is shifted by using the solenoid.

The entry sensor 54 is located between the reverse roller 51 and the reverse branch pawl 53. The exit sensor 64 is located in the vicinity of the carry-out roller 63.

Figure 3:
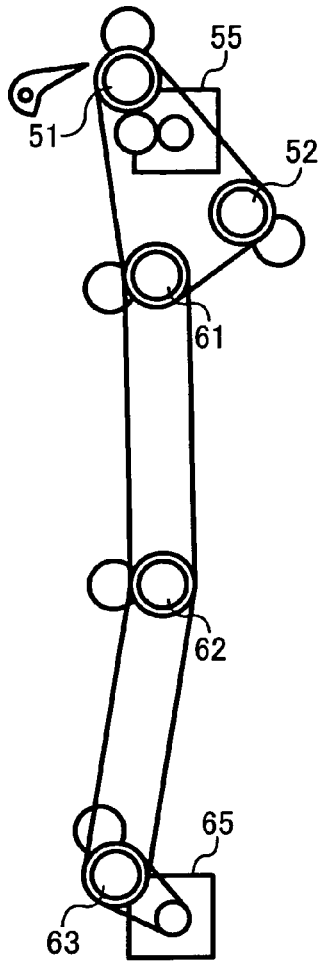
FIG. 3 is a schematic illustration of a mechanism for driving the sheet conveyance rollers shown in FIG. 2.

A general configuration of a mechanism for driving the above rollers in the sheet reversing unit 5 is shown in FIG. 3. As shown in FIG. 3, the sheet reversing unit 5 includes two stepping motors, a reverse motor 55 and a carry-out motor 65, serving as drive sources. The reverse motor 55 drives the reverse roller 51 to rotate in both forward and backward directions, and driving force thereof is transmitted from the reverse roller 51 to the reverse conveyance roller 52 and the first intermediate conveyance roller 61 via a timing belt and a timing pulley. The carry-out motor 65 drives the carry-out roller 63 to rotate, and driving force thereof is transmitted from the carry-out roller 63 to the second intermediate conveyance roller 62 and the first intermediate conveyance roller 61 via another timing belt and another timing pulley.

A mechanism for transmitting the driving force is described below referring to FIG. 4.

Figure 4:
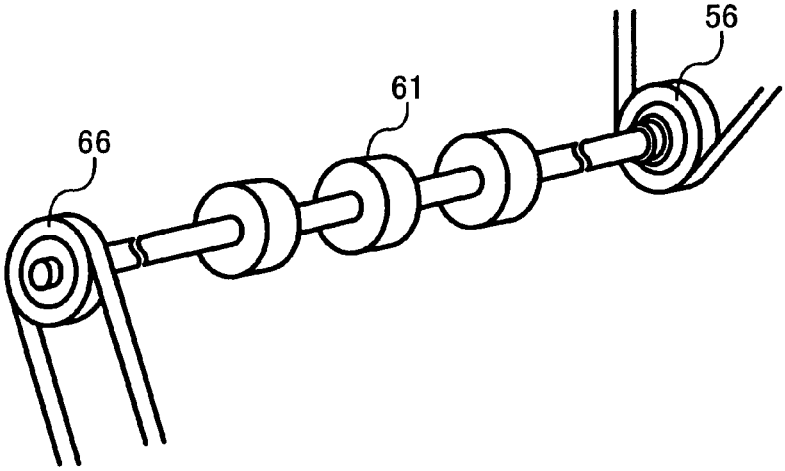
FIG. 4 is a partial perspective view for explaining a drive transmission mechanism of the sheet reversing unit.

As shown in FIG. 4, the sheet reversing unit 5 further includes timing pulleys 56 and 66. The timing pulley 56 includes a built-in one-way clutch (not shown), and is connected to a shaft of the first intermediate conveyance roller 61. The one-way clutch of the timing pulley 56 locks to transmit the driving force of the reverse motor 55 to the first intermediate conveyance roller 61 when the timing pulley 56 is driven in a direction for conveying a sheet into the carry-out conveyance path 60. The one-way clutch of the timing pulley 56 prevents the timing pulley 56 from transmitting the driving force of the reverse motor 55 to the first intermediate conveyance roller 61 when the timing pulley 56 is driven in an opposite direction to the direction. The timing pulley 66 includes another built-in one-way clutch (not shown), and is connected to the first intermediate conveyance roller 61. The one-way clutch of the timing pulley 66 locks to transmit the driving force of the carry-out motor 65 to the first intermediate conveyance roller 61 when the timing pulley 66 is driven in a direction for conveying a sheet along the carry-out conveyance path 60. The one-way clutch of the timing pulley 66 prevents the timing pulley 66 from transmitting the driving force of the carry-out motor 65 to the first intermediate conveyance roller 61 when the timing pulley 66 is driven in an opposite direction to the direction.

The first intermediate conveyance roller 61 receives the driving force from the two motors through the two sets of timing belts and timing pulleys, and conveys a sheet along the carry-out conveyance path 60 toward the carry-out roller 63. Alternatively, the sheet reversing unit 5 can include the first intermediate conveyance roller 61 and a third intermediate conveyance roller having a one-way clutch. The third intermediate conveyance roller can be placed downstream of the first intermediate conveyance roller 61 for receiving the driving force from the carry-out motor 65 through a timing belt and a timing pulley. In this case, a distance from the third intermediate conveyance roller to one of the reverse roller 51 and the entry sensor 54 is set to a value shorter than a length of a smallest size sheet used for double-sided image forming adopting a three-sheet interleaf method. An intermediate waiting position can be set between the first intermediate conveyance roller 61 and the third intermediate conveyance roller. Alternatively, the intermediate waiting position can be set downstream of the third intermediate conveyance roller.

Next, the operation of the sheet reversing unit 5 is described below.

When a front end of a sheet having an image formed on a first side thereof passes through the fixing unit 25 and reaches a predetermined position, the reverse motor 55 starts driving the reverse roller 51 to rotate in a carry-in direction (the sheet is conveyed to the right in FIG. 2). The sheet turns on the entry sensor 54. Then, the reverse roller 51 and the reverse conveyance roller 52 convey the sheet to the lower right. A rear end of the sheet turns off the entry sensor 54 after the rear end of the sheet passes by the entry sensor 54. Then, the reverse motor 55 stops driving, and the solenoid of the reverse branch pawl 53 is turned on.

When a predetermined period of time is passed after the conveyance of the sheet is stopped, the reverse motor 55 starts driving the reverse roller 51 to reversely rotate so that the sheet is switchbacked. The switchbacked sheet turns on the entry sensor 54 again, and is conveyed downward in the carry-out conveyance path 60 by being led by the reverse branch pawl 53, which has been previously shifted by the solenoid.

In a case of forming an image on a single sheet, the carry-out motor 65 starts driving after the sheet to be switchbacked turns on the entry sensor 54. The sheet is conveyed in the carry-out conveyance path 60 by the first intermediate conveyance roller 61, the second intermediate conveyance roller 62, and the carry-out roller 63. A rear end of the sheet turns off the entry sensor 54 after the rear end of the sheet passes by the entry sensor 54. The reverse motor 55 stops after the entry sensor 54 is turned off.

Since the first intermediate conveyance roller 61 is driven by the reverse motor 55 while conveying a first half of the sheet, the first intermediate conveyance roller 61 can surely receive a front end of the sheet even when there is a delay in starting the carry-out motor 65 to drive after the entry sensor 54 is turned on. Further, since the first intermediate conveyance roller 61 is driven by the carry-out motor 65 while conveying a second half of the sheet, the reverse motor 55 may stops after a rear end of the sheet passes by the entry sensor 54 as described above. As the entry sensor 54 is turned off and the reverse motor 55 stops immediately after the rear end of the switchbacked sheet passes by the reverse roller 51, the reverse motor 55 can start driving the reverse roller 51 in the carry-in direction so that a next sheet can be conveyed into the carry-in conveyance path 50. Therefore, a sheet reverse operation can be efficiently performed.

When the sheet is carried out of the sheet reversing unit 5 by using the carry-out roller 63, the sheet is caused to wait at a position of the pair of registration rollers 13. Then, the sheet is conveyed into the image forming unit 2 in predetermined timing, synchronized with an image forming operation performed by the image forming unit 2, so that another image is formed on a second side of the sheet.

Figure 5:
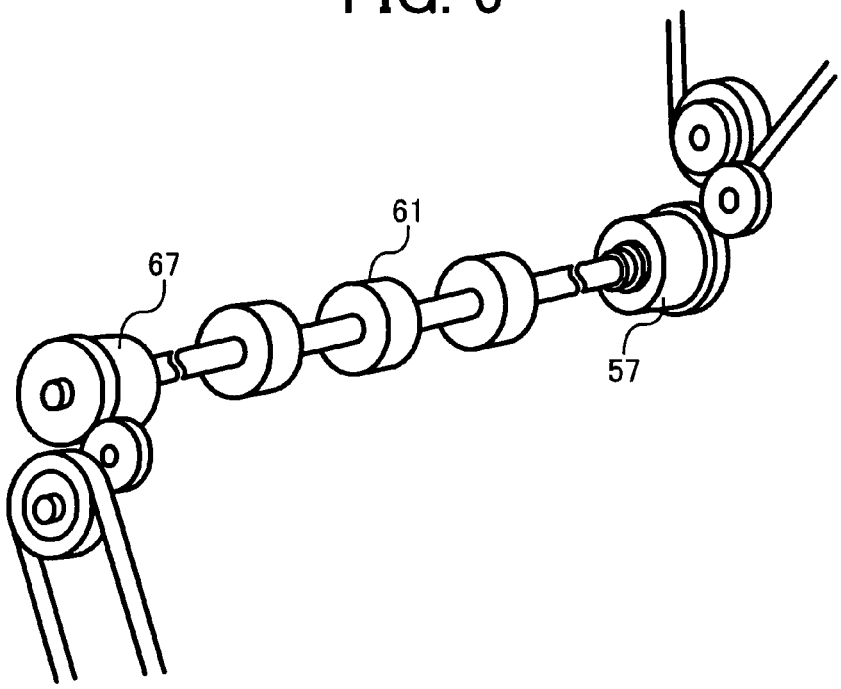
FIG. 5 is a partial perspective view for explaining another drive transmission mechanism of the sheet reversing unit.

As described above, the first intermediate conveyance roller 61 receives the driving force from the reverse motor 55 and the carry-out motor 65 through respective one-way clutches as shown in FIG. 4. Alternatively, the timing pulleys 56 and 66 can be provided with electromagnetic clutches 57 and 67, respectively, so that the first intermediate conveyance roller 61 receives the driving force from the reverse motor 55 and the carry-out motor 65 through the electromagnetic clutches 57 and 67, respectively, as shown in FIG. 5. In the case, when the reverse motor 55 needs to drive the first intermediate conveyance roller 61, the electromagnetic clutch 57 is turned on, and the electromagnetic clutch 67 is turned off. On the other hand, when the carry-out motor 65 needs to drive the first intermediate conveyance roller 61, the electromagnetic clutch 67 is turned on, and the electromagnetic clutch 57 is turned off. While the reverse motor 55 is driving the reverse roller 51 in the carry-in direction before switchbacking a sheet, the electromagnetic clutch 57 is off so as not to transmit the driving force of the reverse motor 55 to the first intermediate conveyance roller 61. On the other hand, when the reverse motor 55 is reversely driving the reverse roller 51 after the sheet is switchbacked, the electromagnetic clutch 57 is turned on to drive the first intermediate conveyance roller 61. In this case, the electromagnetic clutch 67 is off so as not to transmit the driving force of the carry-out motor 65 to the first intermediate conveyance roller 61. After a rear end of the switchbacked sheet passes by and turns off the entry sensor 54, the reverse motor 55 stops, and the electromagnetic clutch 57 is turned off.

On the other hand, when the switchbacked sheet is conveyed by the carry-out roller 63 driven by the carry-out motor 65, the electromagnetic clutch 67 is turned on, and the electromagnetic 57 is turned off so as not to transmit the driving force of the reverse motor 55. Therefore, even when the first intermediate conveyance roller 61 is driven for carrying out the sheet, the reverse motor 55 can drive the reverse roller 51 for conveying a next sheet in the carry-in direction.

Alternatively, the timing pulleys 56 and 66 can be provided with a one-way clutch and an electromagnetic clutch, respectively. Alternatively, the timing pulleys 56 and 66 can be provided with an electromagnetic clutch and a one-way clutch, respectively.

When a plurality of sheets are successively conveyed into the sheet reversing unit 5 for performing, for example, double-sided image forming, the following operation is performed.

In order to achieve the same productivity as productivity of single-sided image forming, after image forming is performed on a first side of a sheet and before image forming is performed on a second side of the sheet, image forming is performed on another sheet (hereinafter referred to as interleaf control). In a case where a length of a sheet in a conveyance direction is shorter than a length of a narrow side (210 mm/216 mm) of standard size paper such as A4 and LT which is most commonly used, three-sheet interleaf control is performed. In a case where the length of a sheet in the conveyance direction is not smaller than the length of the narrow side of the standard size paper, and in a case of A3 and DLT size sheets having lengths twice as long as the length of the standard size paper, two-sheet interleaf control is performed. As a result, double-sided image forming and single-sided image forming have the same productivity.

In the case of the three-sheet interleaf control, images of second, fourth, and sixth pages are formed on first sides of first, second, and third sheets, respectively, in that order, and then, an image of a first page is formed on a second side of the first sheet. Next, images of eighth, third, and tenth pages are formed on a first side of a fourth sheet, a second side of the second sheet, and a first side of a fifth sheet, respectively, in that order. Then, images of fifth, twelfth, and seventh pages are formed on a second side of the third sheet, a first side of a sixth sheet, and a second side of the fourth sheet, respectively, in that order. Image forming is alternately performed on a first side of a sheet and a second side of another sheet as described above, and is successively performed on second sides of three sheets to finish double-sided image forming. In other words, after image forming is performed on a first side of a first sheet and before image forming is performed on a second side of the first sheet, image forming is performed on first sides of next two sheets which are conveyed into the sheet reversing unit 5.

Under the three-sheet interleaf control of the double-sided image forming, the sheet reversing unit 5 operates as described below when a sheet size is LT.

A first sheet P1 having an image formed on a first side thereof is switchbacked, and the carry-out motor 65 stops to cause the first sheet P1 to wait when a front end of the first sheet P1 arrives at a predetermined carry-out waiting position located in the vicinity of an exit located before a meeting point between the carry-out conveyance path 60 and the conveyance path from the sheet feeding tray 11. The arrival of the front end of the first sheet P1 at the predetermined carry-out waiting position is detected by timer-count of a timer that is triggered when the front end of the first sheet P1 turns on the exit sensor 64.

Figure 6:
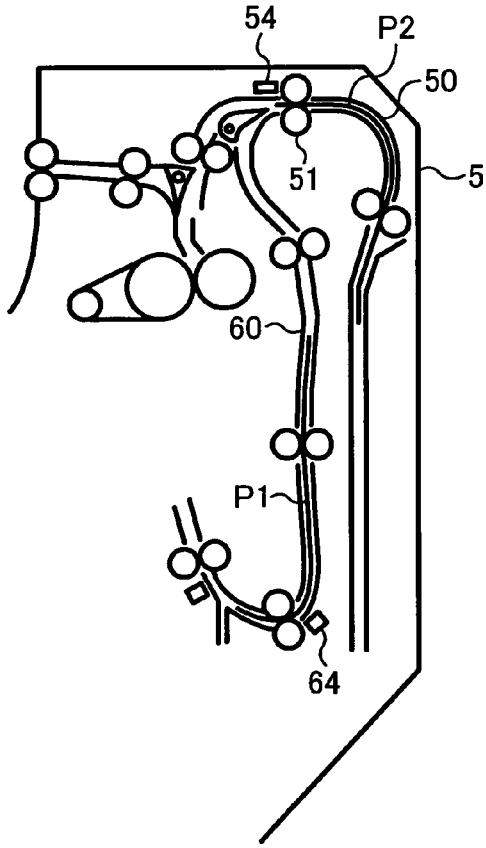
FIG. 6 is a schematic illustration for explaining how sheets are reversed and carried out by the sheet reversing unit.

When image forming is performed on first sides of second and third sheets P2 and P3, the second sheet P2 and the third sheet P3 are conveyed at longer intervals than a normal interval so as to secure enough time for the preceding sheet to be switchbacked by the reverse roller 51. Further, when the second sheet P2 having an image formed on the first side thereof is conveyed into the sheet reversing unit 5, a rear end of the switchbacked first sheet P1 has already turned off the entry sensor 54. Therefore, the reverse motor 55 can drive the reverse roller 51 to rotate in the carry-in direction so that the second sheet P2 is conveyed into the carry-in conveyance path 50 (FIG. 6).

Figure 7:
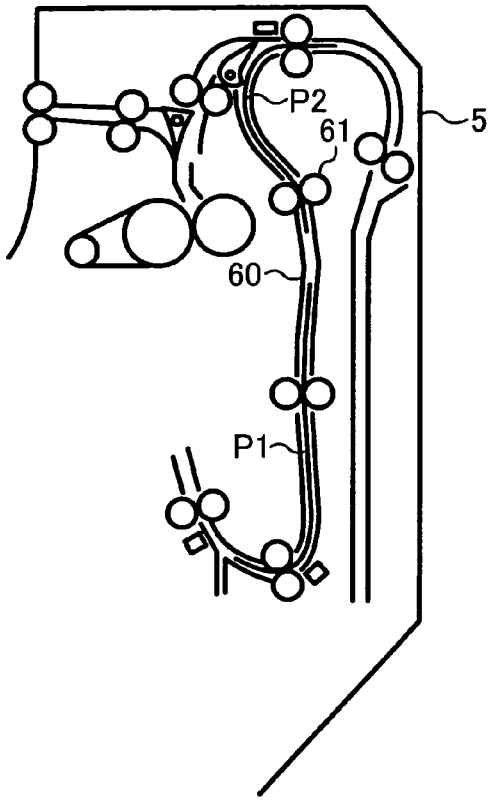
FIG. 7 is a schematic illustration for explaining how sheets are reversed and carried out by the sheet reversing unit.

Alternatively, the first sheet P1 can be under conveyance when the second sheet P2 is conveyed into the sheet reversing unit 5. The first sheet P1 is not necessarily waiting at the carry-out waiting position. In the case, the reverse motor 55 drives the reverse roller 51 to rotate in the carry-in direction, and the carry-out roller 63 drives the carry-out roller 63 to rotate in the carry-out direction. The first intermediate conveyance roller 61 rotates in the carry-out direction. The second sheet P2 conveyed into the carry-in conveyance path 50 is immediately switchbacked. When the front end of the switchbacked second sheet P2 arrives at a predetermined intermediate waiting position located downstream of the first intermediate conveyance roller 61, and when the preceding first sheet P1 is waiting at the carry-out waiting position, the reverse motor 55 stops so as to cause the second sheet P2 to wait at the intermediate waiting position (FIG. 7).

A distance between the intermediate waiting position and the carry-out waiting position is set to a value larger than a length $L_1$ of a largest sheet on which the three-sheet interleaf control is performed. In the embodiment of the present invention, the length $L_1$ is 216 mm which is a length of a narrow side of an LT size sheet. For example, the intermediate waiting position is located at a conveyance distance of 170 mm away from the entry sensor 54 (the conveyance distance between the entry sensor 54 and the intermediate waiting position is shorter than $L_1$). Arrival of a front end of a sheet at the intermediate waiting position is detected by timer-count of a timer which is triggered when the sheet turns on the entry sensor 54 after being switchbacked.

Alternatively, the intermediate waiting position can be variably controlled according to a size of a sheet on which image forming is performed. When the third sheet P3 is conveyed from the pair of registration rollers 13 into the image forming unit 2, and as image forming is started on the first side thereof, a rear end of the third sheet P3 turns off the registration sensor 12. Then, the carry-out motor 65 starts driving the carry-out roller 63 to convey the first sheet P1 waiting at the carry-out waiting position toward the pair of registration rollers 13. At the time, in a case where the second sheet P2 is waiting at the intermediate waiting position, the reverse motor 55 can be simultaneously driven in the carry-out direction when the carry-out motor 65 is driven so that the second sheet P2 and the first sheet P1 are conveyed while keeping a constant interval therebetween.

Figure 8:
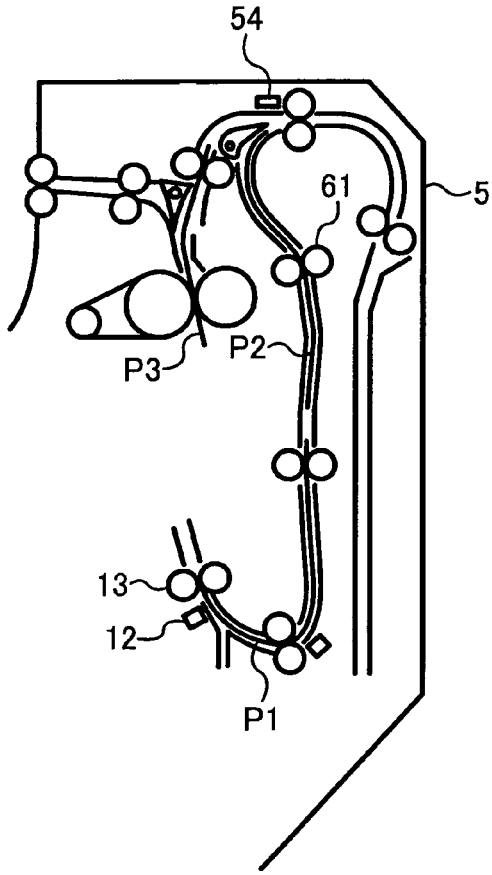
FIG. 8 is a schematic illustration for explaining how sheets are reversed and carried out by the sheet reversing unit.

After the first sheet P1 reaches the pair of registration rollers 13, the carry-out motor 65 stops so as to cause the first sheet P1 to wait for synchronization with image forming. The reverse motor 55 stops after the rear end of the second sheet P2 turns off the entry sensor 54. In the case where the sheet size of the narrow side is LT, although the reverse motor 55 stops after the carry-out motor 65 stops, the second sheet P2 can be conveyed even after the carry-out motor 65 has stopped since the first intermediate conveyance roller 61 rotates by being driven by the reverse motor 55 in the carry-out direction. In this case, although the interval between the first and second sheets is shortened, the shortened interval can be kept and the first and second sheets may not conflict with each other since a distance $L_2$ between the entry sensor 54 and the pair of registration rollers 13 is set to a value larger than the length $L_1$ multiplied by a factor of two (FIG. 8).

In a case where a small-sized sheet such as B5 arranged in landscape orientation is conveyed, since the rear end of the second sheet P2 turns off the entry sensor 54 before the first sheet P1 reaches the pair of registration rollers 13, the carry-out motor 65 stops after the reverse motor 55 stops. In this case, since the first intermediate conveyance roller 61 rotates by being driven by the carry-out motor 65 even after the reverse motor 55 has stopped, the second sheet P2 is conveyed as the first sheet P1 is conveyed while keeping a constant interval therebetween.

When the first sheet P1 is conveyed into the image forming unit 2 from the pair of registration rollers 13, the carry-out motor 65 is driven simultaneously when the pair of registration rollers 13 is driven so that both the first sheet P1 and the second sheet P2 are conveyed. The carry-out motor 65 stops after the front end of the second sheet P2 turns on the exit sensor 64 and is conveyed to the carry-out waiting position. Since image forming is performed on a first side of a fourth sheet fed from the sheet feeding tray 11 after image forming is performed on a second side of the first sheet P1, the second sheet P2 is caused to wait at the carry-out waiting position. At the same time, a third sheet P3 having an image formed on a first side thereof is conveyed into the sheet reversing unit 5, switchbacked, and conveyed toward the intermediate waiting position by being driven by the reverse motor 55.

In both a case where a preceding sheet has already been carried out from the carry-out waiting position and a case where a preceding sheet is waiting at the position of the pair of registration rollers 13 when one of the second sheet P2 and sheets thereafter reaches the intermediate waiting position, the sheet is not stopped at the intermediate waiting position, and the reverse motor 55 continues driving until a rear end of the sheet turns off the entry sensor 54. In a case where the preceding sheet is under conveyance even after the reverse motor 55 stops driving, the first intermediate conveyance roller 61 conveys the sheet by being driven by the carry-out motor 65. In a case where the preceding sheet is stopped at the position of the pair of registration rollers 13, on the other hand, the sheet is stopped, and conveyance thereof is restarted to follow conveyance of the preceding sheet.

Whether or not a sheet is caused to wait at the intermediate waiting position does not depend on a size of the sheet, but on setting of an interval between sheets, in other words, setting of productivity. On the fourth sheet and sheets thereafter, image forming is alternately performed on a sheet fed from the sheet feeding tray 11 and a sheet carried out of the sheet reversing unit 5. Therefore, image forming can be performed at the same interval as single-sided image forming after image forming is performed on a second side of a first sheet. As a result, productivity of double-sided image forming is the same as productivity of single-sided image forming.

In the case where the configuration includes the first and third intermediate conveyance rollers with the intermediate waiting position located downstream of the third intermediate conveyance roller, when a preceding sheet (a first sheet) is stopped at the carry-out waiting position, the third intermediate conveyance roller is also stopped. Further, a sheet is conveyed by the reverse motor 55 to the third intermediate conveyance roller. The third intermediate conveyance roller having the one-way clutch rotates and conveys the sheet to the intermediate waiting position, and then the reverse motor 55 stops so as to cause the sheet to wait.

In the case where the configuration includes the first and third intermediate conveyance rollers with the intermediate waiting position located between the first and third intermediate conveyance rollers, the reverse motor 55 stops after the carry-out motor 65 stops when a sheet size of the narrow side is LT. The first intermediate conveyance roller rotates by being driven by the reverse motor 55 in the carry-out direction. The first intermediate conveyance roller having the one-way clutch rotates and conveys both the second sheet P2 and the first sheet P1 while keeping a constant interval therebetween.

In the case of the two-sheet interleaf control that is mainly used for a large size sheet, images of second and fourth pages are formed on first sides of first and second sheets, respectively, in that order. Then, an image of a first page is formed on a second side of the first sheet. Next, images of sixth, third, and eighth pages are formed on a first side of a third sheet, a second side of the second sheet, and a first side of a fourth sheet, respectively, in that order. Then, images of fifth and tenth pages are formed on a second side of the third sheet and a first side of a fifth sheet, respectively, in that order. Image forming is alternately performed on a first side of a sheet and a second side of another sheet as described above, and is successively performed on second sides of two sheets to finish double-sided image forming. In other words, after image forming is performed on a first side of a first sheet and before image forming is performed on a second side of the first sheet, image forming is performed on a first side of a next sheet which is conveyed into the sheet reversing unit 5.

In this case, the sheet reversing unit 5 operates as described below. The same operation as the operation for the three-sheet interleaf control is omitted.

A first sheet having an image formed on a first side thereof is switchbacked as in the case of the three-sheet interleaf control, and the carry-out motor 65 stops to cause the first sheet to wait when a front end of the first sheet arrives at the predetermined carry-out waiting position located in the vicinity of the exit located before the meeting point between the carry-out conveyance path 60 and the conveyance path from the sheet feeding tray 11. In a case in which a rear end of the first sheet turns off the entry sensor 54, the revere motor 55 stops when the entry sensor 54 is turned off. In another case in which the first sheet arrives at the carry-out waiting position before the rear end of the first sheet turns off the entry sensor 54, the reverse motor 55 stops simultaneously when the carry-out motor 65 stops.

A distance between the reverse roller 51 and the carry-out waiting position is set to a value larger than a length $L_2$ of a largest sheet on which the two-sheet interleaf control is performed. Therefore, even in the case in which the first sheet arrives at the carry-out waiting position before the entry sensor 54 is turned off, the rear end of the first sheet is located between the reverse roller 51 and the entry sensor 54, and the reverse roller 51 does not hold the first sheet.

When image forming is performed on a first side of a second sheet, the second sheet is conveyed at a longer interval than the normal interval so as to secure enough time for the first sheet to be switchbacked by the reverse roller 51. Conveyance of the first sheet toward the pair of registration rollers 13 is restarted by driving the carry-out motor 65 after a rear end of the second sheet turns off the registration sensor 12. When the second sheet received into the carry-in conveyance path 50 stops after the rear end thereof turns off the entry sensor 54, confirmed restarting of conveyance of the first sheet (preceding sheet) from the pair of registration rollers 13 to the image forming unit 2 causes the reverse motor 55 to start rotating the reverse roller 51 in the carry-out direction to switchback the second sheet. When the preceding first sheet is waiting at the position of the pair of registration rollers 13, driving of the reverse motor 55 is not started and the second sheet is not carried out. When switchbacked, the second sheet does not wait at the intermediate waiting position, but is conveyed to the carry-out conveyance position to stop. The second sheet waits at the carry-out conveyance position until a rear end of a third sheet supplied from the sheet feeding tray 11 turns off the registration sensor 12 after an image is formed on a first side thereof.

The above procedures are repeated thereafter so that images are alternately formed on one of the sheets supplied from the sheet feeding tray 11 and one of the sheets carried out of the sheet reversing unit 5.

This patent specification is based on Japanese patent applications, No. JP2005-182656 filed on Jun. 22, 2005, No. JP2005-211188 filed on Jul. 21, 2005, and No. JP2006-008667 filed on Jan. 17, 2006, in the Japan Patent Office, the entire contents of which are incorporated by reference herein.

What is claimed as new and desired to be secured by Letters Patent of the United States is:

1. A sheet conveyance apparatus, comprising:

a sheet conveyance path;

a first conveyance mechanism located upstream in the sheet conveyance path;

a first drive mechanism configured to drive the first conveyance mechanism to convey a sheet forward and backward;

a second conveyance mechanism located downstream in the sheet conveyance path;

a second drive mechanism configured to drive the second conveyance mechanism;

a first intermediate conveyance mechanism located between the first and second conveyance mechanisms in the sheet conveyance path;

a first drive transmission mechanism configured to intermittently transmit drive force from the first drive mechanism to the first intermediate conveyance mechanism in a backward direction, when the first conveyance mechanism is being driven backward by the first drive mechanism; and a second drive transmission mechanism configured to intermittently transmit drive force from the second drive mechanism to the first intermediate conveyance mechanism so that the first intermediate conveyance mechanism drives the sheet backward while the first drive mechanism drives the first conveyance mechanism forward.

2. The sheet conveyance apparatus according to claim 1, further comprising:

a second intermediate conveyance mechanism located between the first intermediate conveyance mechanism and the second conveyance mechanism in the sheet conveyance path.

3. The sheet conveyance apparatus according to claim 2, further comprising a control mechanism configured to control conveyance of a sheet reversed by the first conveyance mechanism so that the conveyance of the sheet is stopped when a front end thereof arrives at a carry-out waiting position located downstream of the second conveyance mechanism in the sheet conveyance path and at an intermediate waiting position located between the first and second intermediate conveyance mechanisms.

4. The sheet conveyance apparatus according to claim 2, further comprising a control mechanism configured to control conveyance of a sheet reversed by the first conveyance mechanism so that the conveyance of the sheet is stopped when a front end thereof arrives at a carry-out waiting position located downstream of the second conveyance mechanism in the sheet conveyance path and at an intermediate waiting position located between the second intermediate conveyance mechanism and the second conveyance mechanism.

5. The sheet conveyance apparatus according to claim 3, wherein a distance between the second intermediate conveyance mechanism and the first conveyance mechanism is a value smaller than a length of a smallest size sheet subjected to a double-sided image forming operation under three-sheet interleaf control.

6. The sheet conveyance apparatus according to claim 3, wherein a distance between the intermediate waiting position and the carry-out waiting position is greater than a value, and a distance between the first conveyance mechanism and the intermediate waiting position is smaller than the value.

7. The sheet conveyance apparatus according to claim 6, wherein a distance between the first conveyance mechanism and the carry-out waiting position is greater than the value multiplied by 2.

8. The sheet conveyance apparatus according to claim 7, wherein the first drive mechanism is configured to stop driving the first conveyance mechanism so that conveyance of a sheet reversed by the first conveyance mechanism is stopped when a front end of the sheet arrives at the intermediate waiting position while another sheet is waiting at the carry-out waiting position.

9. The sheet conveyance apparatus according to claim 8, wherein the first drive mechanism is further configured to, after conveyance of the sheet is stopped when the front end of the sheet arrives at the intermediate waiting position, restart driving the first conveyance mechanism to rotate in a sheet carry-out direction simultaneously when the second drive mechanism starts driving.

10. The sheet conveyance apparatus according to claim 9, wherein the first drive mechanism is further configured to stop driving the first conveyance mechanism after a rear end of a sheet reversed by the first conveyance mechanism passes by the first conveyance mechanism.

11. The sheet conveyance apparatus according to claim 1, further comprising a control mechanism configured to control conveyance of a sheet reversed by the first conveyance mechanism so that the conveyance of the sheet is stopped when a front end thereof arrives at a carry-out waiting position located downstream of the second conveyance mechanism in the sheet conveyance path and at an intermediate waiting position located between the first intermediate conveyance mechanism and the second conveyance mechanism.

12. The sheet conveyance apparatus according to claim 1, wherein the second drive transmission mechanism is configured to perform one-way transmission of the drive force.

13. An image forming apparatus, comprising:

a sheet conveyance apparatus including:

a sheet conveyance path;

a first conveyance mechanism located upstream in the sheet conveyance path;

a first drive mechanism configured to drive the first conveyance mechanism to convey a sheet forward and backward;

a second conveyance mechanism located downstream in the sheet conveyance path;

a second drive mechanism configured to drive the second conveyance mechanism;

a first intermediate conveyance mechanism located between the first and second conveyance mechanisms in the sheet conveyance path;

a first drive transmission mechanism configured to intermittently transmit drive force from the first drive mechanism to the first intermediate conveyance mechanism in a backward direction, when the first conveyance mechanism is being driven backward by the first drive mechanism; and a second drive transmission mechanism configured to intermittently transmit drive force from the second drive mechanism to the first intermediate conveyance mechanism so that the first intermediate conveyance mechanism drives the sheet backward while the first drive mechanism drives the first conveyance mechanism forward.

14. The image forming apparatus according to claim 13, wherein n represents a number of the sheets carried into the sheet conveyance apparatus after image forming is performed on one side of a sheet and before image forming is performed on the other side of the sheet when double-sided image forming is successively performed on a plurality of sheets, and wherein n is equal to 2 when a length of a sheet carried into the sheet conveyance apparatus is equal to or smaller than a value, n is equal to 1 when the length of the sheet is greater than the value and is shorter than a distance between the first conveyance mechanism and a carry-out waiting position, and n is equal to 0 when the length of the sheet is equal to or greater than the distance between the first conveyance mechanism and the carry-out waiting position.

15. The image forming apparatus according to claim 14, wherein the distance between the first conveyance mechanism and the carry-out waiting position is greater than the value multiplied by 2.

16. The image forming apparatus according to claim 15, wherein the distance between the first conveyance mechanism and the carry-out waiting position is greater than a length of a largest sheet on which image forming is performed.

* * * * *